US008183780B2

(12) United States Patent
Morkel

(10) Patent No.: US 8,183,780 B2
(45) Date of Patent: May 22, 2012

(54) DISCHARGE LAMP AND METHOD FOR PRODUCING A BULB NECK FOR A DISCHARGE LAMP

(75) Inventor: Matthias Morkel, Berlin (DE)

(73) Assignee: Osram AG, Munich (DE)

( * ) Notice: Subject to any disclaimer, the term of this patent is extended or adjusted under 35 U.S.C. 154(b) by 244 days.

(21) Appl. No.: 12/448,030

(22) PCT Filed: Dec. 7, 2006

(86) PCT No.: PCT/EP2006/069419

§ 371 (c)(1),
(2), (4) Date: Jun. 4, 2009

(87) PCT Pub. No.: WO2008/067850

PCT Pub. Date: Jun. 12, 2008

(65) Prior Publication Data

US 2010/0001643 A1 Jan. 7, 2010

(51) Int. Cl.
*H01J 17/04* (2006.01)

(52) U.S. Cl. ..... 313/631; 313/621; 313/623; 445/26

(58) Field of Classification Search ..... 313/483–493, 313/623, 627–643, 567, 111–117, 25–27, 313/317, 318.01–318.09; 439/615, 739; 445/24, 26, 29, 22

See application file for complete search history.

(56) References Cited

U.S. PATENT DOCUMENTS

| | | | | |
|---|---|---|---|---|
| 2,200,939 | A | 5/1940 | Trebbin et al. | |
| 4,673,843 | A * | 6/1987 | Okanuma | 313/570 |
| 5,793,160 | A | 8/1998 | Losco | |
| 6,624,576 | B1 * | 9/2003 | Mittler | 313/623 |
| 7,279,839 | B2 | 10/2007 | Menzel et al. | |
| 2005/0104521 | A1 * | 5/2005 | Berndanner et al. | 313/633 |
| 2009/0039785 | A1 * | 2/2009 | Yasuda et al. | 313/634 |

FOREIGN PATENT DOCUMENTS

| | | |
|---|---|---|
| DE | 102 09 426 A1 | 9/2003 |
| GB | 2 175 130 A | 11/1986 |

* cited by examiner

*Primary Examiner* — Mariceli Santiago
*Assistant Examiner* — Donald Raleigh
(74) *Attorney, Agent, or Firm* — Holtz, Holtz, Goodman & Chick, PC

(57) ABSTRACT

The invention relates to a discharge lamp with a discharge vessel (2) and at least one bulb neck (I, II) connected thereto with an inner quartz bar (6) and a first foil arrangement (9), which is arranged on the outer side (63) of the quartz bar (6) and is connected to power supply lines (7*a*, 7*b*) for an electrode (4, 5) which are arranged on both sides of the quartz bar (6), wherein the bulb neck (I, II) comprises at least one second foil arrangement (13), which is connected to the power supply lines (7*a*, 7*b*) and has a greater distance with respect to the longitudinal axis (A) of the quartz bar (6) than the first foil arrangement (9). The invention also relates to a method for producing a bulb neck of a discharge lamp.

29 Claims, 6 Drawing Sheets

DISCHARGE LAMP AND METHOD FOR PRODUCING A BULB NECK FOR A DISCHARGE LAMP

This application is a U.S. National Phase Application under 35 USC 371 of International Application PCT/EP2006/069419, filed Dec. 7, 2006, which is incorporated herein in its entirety by this reference.

TECHNICAL FIELD

The invention relates to a discharge lamp with a discharge vessel and at least one bulb neck adjacent thereto with an inner quartz bar and a first film arrangement arranged on the outer side of the quartz bar, which film arrangement is connected to power supply lines for an electrode which are arranged on both sides of the quartz bar. Furthermore, the invention relates to a method for producing a bulb neck for a discharge lamp.

PRIOR ART

The power supply line in the case of mercury-vapor lamps (HBO lamps) or lamps with quartz glass bulbs without transition glass in the sealing region is produced in the case of high lamp currents (greater than 50 A) by a round film fuse seal. This system comprises a quartz bar, on which thin sealing films made from molybdenum (Mo films) are arranged equidistantly. The film strips have a thickness of between 25 and 60 μm and a width of approximately 6 to 12 mm. The quartz bar with the film strips is fused with an outer tube, which firstly seals the discharge vessel with respect to the atmosphere and secondly also acts as a power supply line to an electrode. A bulb neck of a discharge lamp designed in this way is known from DE 102 09 426 A1.

One problem with such a configuration of a bulb neck of a discharge lamp consists in the fact that the film strips can only be subjected to a maximum current. In the case of a simple round fuse seal, the number of films is geometrically limited for the given quartz bar diameter. Furthermore, the bursting pressure resistance of the lamps scales with the quartz bar diameter. The maximum permissible current also scales with the added total cross section of the films. If the current requirement is higher, it is possible with the prior art system either to increase the thickness of the films or to increase the quartz bar diameter and at the same time the number of or the width of the films. However, these are both only possible to a limited extent since, firstly, the sealing capacity of the film system and the bursting pressure resistance of the overall construction, which scales with the quartz bar diameter, need to be ensured.

The mentioned solutions therefore only provide a certain improvement as regards the criteria to be met in relation to a relatively high current-carrying capacity, on the one hand, and a maximum sealtightness and bursting pressure resistance, on the other hand.

DESCRIPTION OF THE INVENTION

The object of the present invention is to provide a discharge lamp and a method for producing a bulb neck of a discharge lamp, in which or with which increased current transport via the power supply lines can be ensured and the sealtightness of the fused-in bulb neck can be ensured.

This object is achieved by a discharge lamp having the features according to patent claim 1 and a method having the features according to patent claim 19.

A discharge lamp according to the invention comprises a discharge vessel and at least one bulb neck adjacent thereto with an inner quartz bar and a first film arrangement arranged on the outer side of the quartz bar. The first film arrangement is connected to power supply lines for an electrode which are arranged on both sides of the quartz bar. The bulb neck comprises at least one second film arrangement, which is connected to the power supply lines and, at least in regions, is at a greater distance from the longitudinal axis of the quartz bar than the first film arrangement. A multilayered film system is thus produced in the bulb neck, which multilayered film system is arranged in particular along the longitudinal extent of the quartz bar at different distances from the longitudinal axis of the quartz bar. The quartz bar is therefore surrounded, at least in regions, by a first film arrangement and by a second film arrangement, the second film arrangement being arranged in such a way that it virtually surrounds the first film arrangement.

This configuration makes it possible, given a compact design, to improve the supply of power and furthermore also to ensure the sealtightness of the bulb neck. As a result of these at least two film planes, the demand for a large added sealing film cross section with a small outer diameter for the purpose of increasing the bursting pressure resistance of the discharge lamp can be met.

Advantageously, the first film arrangement is arranged directly on the outer side forming the lateral surface of the quartz bar. Owing to the fact that the first film arrangement is applied directly in this way, it is possible to make use of an already existing surface, as a result of which further manufacturing steps are saved. Furthermore, the dimensioning of the quartz bar makes it possible to variably predetermine this surface area.

Preferably, the first film arrangement and the second film arrangement each comprise a plurality of film strips. The film strips of a film arrangement can overall have substantially the same design and can therefore have substantially the same thickness, the same width and the same length. However, it may also be provided that film strips of a film arrangement are different in terms of at least one of the parameters thickness, width and length. Furthermore, it may also be provided that the film strips of the first film arrangement have substantially the same design, but are designed differently than the configurations of the film strips of the second film arrangement. In this case, the configuration which is the best possible one in each case for a discharge lamp can be manufactured depending on the situation.

Preferably, the film strips of the first film arrangement are positioned equidistantly with respect to one another, when viewed in the circumferential direction of the quartz bar, on the outer side of the quartz bar, and are arranged at a first distance from the longitudinal axis of the quartz bar. Preferably, this distance is the radius of the cross section of the quartz bar. The film strips of the second film arrangement are preferably likewise arranged equidistantly with respect to one another, when viewed in the circumferential direction of the quartz bar, and are arranged at a second distance from the longitudinal axis of the quartz bar. When viewed in the circumferential direction, this can enable a highly symmetrical configuration. Preferably, an electrically insulating material, in particular a glass material, is formed between the first film arrangement and the second film arrangement, when viewed in the direction of the longitudinal axis. The two film arrangements are therefore in particular arranged so as to be spaced apart from one another or one above the other in the region of the length of the quartz bar. This configuration makes it possible to achieve particularly effective sealtightness during the fuse-sealing process.

Preferably, the outer side of the first outer tube is designed to be planar. In particular, the outer tube is designed in such a way that it has an identical outer diameter over the length.

Preferably, an outer tube of the bulb neck is arranged on the outer side of the second film arrangement.

Preferably, at least one of the power supply lines is connected to a first plate, which bears against an end side of the quartz bar and is mechanically and electrically connected to the first film arrangement. Provision is preferably made for a respective first plate to be arranged on both sides of the quartz bar, which plates each bear against the facing end side of the quartz bar and are connected to the first film arrangement.

Preferably, the first plates have dimensions which correspond to the two-dimensional dimensions of the facing end side. The first plates can therefore each be arranged flush with respect to the lateral surface of the quartz bar, with the result that the film arrangement, in particular the film strips of the first film arrangement, can also be fitted in planar fashion and therefore in parallel fashion with respect to the longitudinal axis of the quartz bar over the entire length.

Preferably, at least one of the power supply lines is connected to a second plate, which is connected to the second film arrangement and is arranged so as to be spaced apart from the first plate in the direction of the longitudinal axis. In particular, provision may also be made here for each of the power supply lines arranged on both sides of the quartz bar to be connected to a separate second plate, which respective second plate is positioned so as to be spaced apart from the respective first plate arranged on this side of the quartz bar. In this case too, a second plate preferably has two-dimensional dimensions, which are formed with the two-dimensional dimensions of the quartz bar with the first film arrangement arranged thereon and the electrically insulating material fitted thereon. This configuration makes it possible to produce a symmetrical construction which also ensures, in optimum fashion, the fitting of the second film arrangement. Thus, the film strips of the second film arrangement can then preferably be arranged substantially parallel to the longitudinal axis over the entire length and can be connected to the power supply lines, in particular to the plates.

Provision may also be made for the second film arrangement to also be connected to a first plate, at least on one side. In particular, it can be provided that, when no second plate and only a respective first plate is arranged on both sides of the quartz bar, the second film arrangement is also connected on both sides to these first plates. A configuration which minimizes installation space and saves on materials can thus be ensured.

Preferably, a spacer element, in particular a quartz tube section, is arranged between a first plate and a second plate on one side of the quartz bar. Preferably, this quartz tube section has two-dimensional dimensions, which correspond to the flat dimensions of the first plate with the film strips fitted thereon of the first film arrangement. In this case, too, substantially a flush transition between the quartz tube section and the first plate or the first film arrangement can therefore then be made possible. It is thus possible to prevent a first outer tube which is then fitted thereon or the electrically insulating material from falling in the space behind the first plates.

Preferably, the first plate has a smaller diameter than the second plate.

The second plate and the bar-shaped power supply line on one side of the quartz bar are preferably connected by a connecting element. These second plates need to be electrically connected to the power supply lines. In this case, soldering is impossible in practice since the glass/metal composite system does not withstand high temperatures in this region owing to the glass present. Owing to this fact it is therefore advantageous to provide a different connection.

Provision may also be made for the connecting element to be an element in the form of a cylindrical hat, which has been pushed onto the bar-shaped power supply line, bears against the rear side of the second plate and is mechanically stably connected, in particular welded, to the second plate and the power supply line. In this configuration, the second plate is therefore not fitted directly to the bar-shaped power supply line, but a specially shaped open cylindrical hat is welded flat onto the rear side of the second plate and to the bar-shaped power supply line.

Preferably, the connecting element is formed from a high-melting material, in particular at least proportionally from tantalum. The material can also be made at least proportionally from molybdenum and/or tungsten and/or tantalum. This allows for an optimum and stable connection, which is in particular resistant to high temperatures.

Preferably, the second film arrangement, at least on one side of the quartz bar, when viewed in the longitudinal direction, is connected, in particular welded, directly to the power supply line arranged on this side. Since in particular the second plates virtually do not perform a holding function, these second plates can also be dispensed with entirely. Precisely in the case of such a configuration, the second film arrangement can then be electrically connected to the bar-shaped power supply lines with little complexity involved. The direct connection between the second film arrangement and the bar can in this case be provided.

In the event that at least one of the second plates is dispensed with, it is furthermore possible to provide a further connection between the second film arrangement and a power supply line to the extent that this second film arrangement, at least on one side of the quartz bar, is connected directly to a connecting part in the form of a cylindrical hat, which is connected directly to a power supply line. It can therefore be provided in this configuration for the second film arrangement to be welded directly to a specially shaped cylindrical body, the connecting part, whose circumferentially flat edge has a corresponding diameter. The second film arrangement is preferably flanged at the edge of this cylindrical body and welded onto the edge surface. The electrical connection between the cylindrical body and a bar-shaped power supply line is then likewise preferably provided by means of a welding operation.

Preferably, a second spacer element, in particular a second quartz tube section, is arranged in the longitudinal axis direction on that side of the connecting element or of the connecting part which is remote from the quartz bar.

It can also be provided that a supporting element, in particular a tapered supporting element, is arranged in the longitudinal axis direction on that side of the connecting element or of the connecting part which is remote from the quartz bar. The in particular conical element, which is also referred to as a supporting roller, is preferably formed from a glass material. Provision is made in particular for this tapered supporting element to be arranged with its tapered end region so as to face the discharge space of the discharge vessel.

In a method according to the invention for producing a bulb neck for a discharge lamp, this bulb neck is formed on a discharge vessel. A quartz bar is formed on the inside in the bulb neck, with a first film arrangement being fitted on the outer side of said quartz bar. The first film arrangement is connected, on both sides of the quartz bar, to power supply lines for an electrode of the discharge lamp which are likewise arranged on both sides of the quartz bar. A second film arrangement is formed in the bulb neck, which second film arrangement is connected to the power supply lines and, at least in regions, is formed at a greater distance from the longitudinal axis of the quartz bar than the first film arrangement. Owing to this procedure, a twin fuse-sealing system with two film planes in the bulb neck can be produced. The demand for a large added sealing film cross section with a small outer diameter of the bulb neck in order to increase the bursting pressure resistance can thus be met.

The general wording that a first film arrangement is arranged on the outer side of the quartz bar can be understood to mean both the direct arrangement thereon and an indirect arrangement in which a further element or a further layer is fitted between the quartz bar and the film arrangement.

Preferably, a plurality of equidistantly arranged film strips are formed parallel to one another on the outer side, which forms the lateral surface, of the quartz bar, which film strips are connected, in particular welded, to a first plate at least on one side, the first plate being connected, in particular soldered, to the power supply line arranged on this side.

Preferably, first spacer elements, in particular first quartz tube sections, are fitted on both sides of the quartz bar, and a first outer tube is pushed onto the quartz bar, the first film arrangement, the at least one first plate and the spacer elements, and this intermediate arrangement thus formed is then fuse-sealed. The gas-tight connection can thus be ensured.

Preferably, the outer side of the first outer tube is planarized. This planarization of the outer side can take place, for example, by means of grinding or flame-polishing or by means of laser treatment. Preferably, the planarization takes place in such a way that the outer tube has a constant outer diameter over its length.

Preferably, the first film arrangement is formed at a smaller distance from the longitudinal axis of the quartz bar than the second film arrangement. This is provided in particular over the entire length of the quartz bar.

Preferably, a glass material is formed between the first film arrangement and the second film arrangement. This can preferably take place by virtue of the first outer tube acting as electrically insulating material between the two film arrangements.

Preferably, the second film arrangement is applied to the outer side of the first outer tube and is connected to the power supply lines. The second film arrangement can preferably take place via second plates arranged in particular on both sides of the quartz bar so as to form the power supply lines. However, it can also be provided that the second film arrangement is connected to a first plate, at least on one side of the quartz bar, and is therefore electrically connected to the power supply line arranged on this side.

Preferably, the second film arrangement is connected, in particular welded, at least on one side of the quartz bar, directly to the power supply line arranged on this side.

It can also be provided that a second plate, which is connected to the second film arrangement, is arranged at least on one side of the quartz bar. The second plate can be connected to a connecting element, in particular to a connecting element in the form of a cylindrical hat, the second plate and the power supply line being welded to the connecting element.

At least on one side of the quartz bar, when viewed in the direction of the longitudinal axis, a second spacer element, in particular a second quartz tube section, is arranged on that side of the first spacer element which is remote from the quartz bar, in particular on that side of the second plate or of the connecting element which is remote from the quartz bar.

Preferably, once an electrode has been fitted on the power supply line facing the discharge space, this final arrangement manufactured in this way is introduced into a second outer tube and fused therewith in a gas-tight manner.

Further advantageous configurations of the discharge lamp according to the invention can be considered advantageous configurations of the method according to the invention.

BRIEF DESCRIPTION OF THE DRAWINGS

An exemplary embodiment of the invention will be explained in more detail below with reference to schematic drawings, in which.

PREFERRED EMBODIMENT OF THE INVENTION

Identical or functionally identical elements have been provided with the same reference symbols in the figures.

Figure 1:
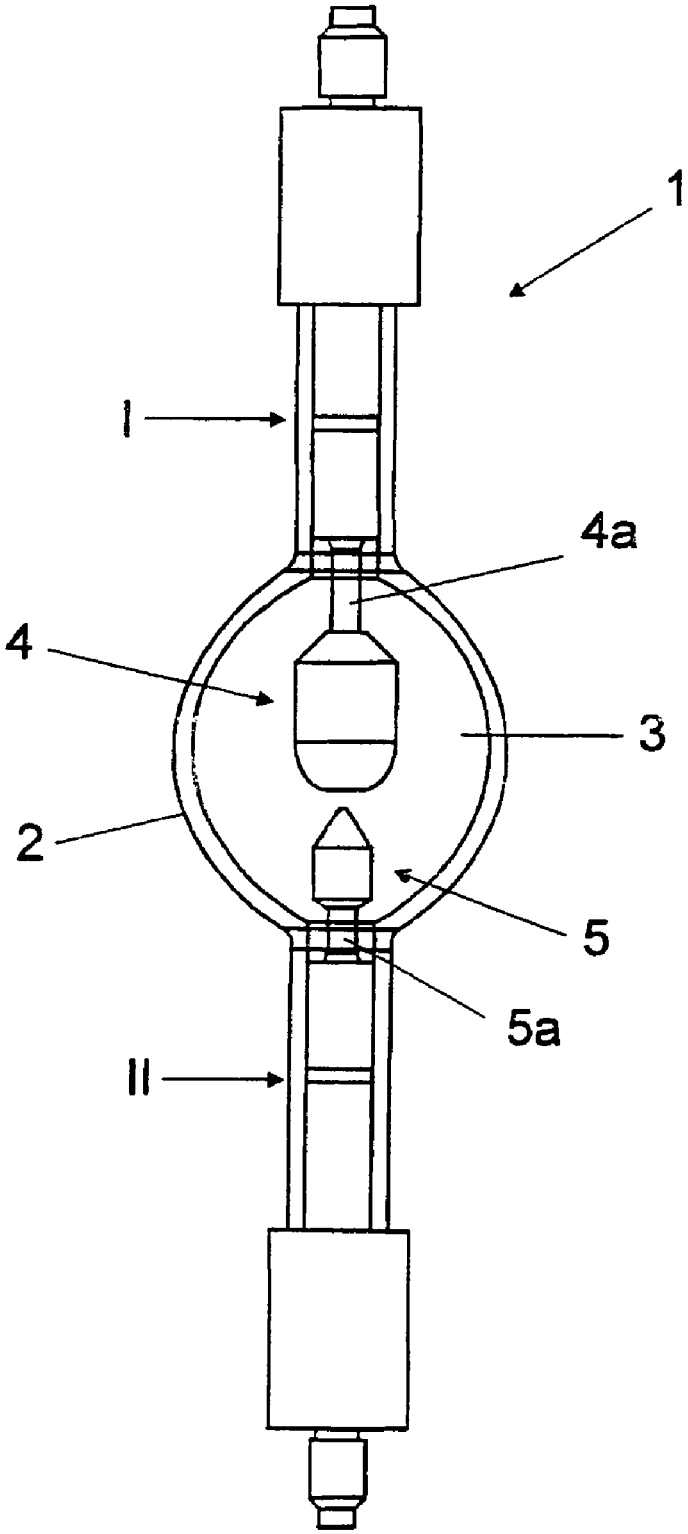
FIG. 1 shows a schematic illustration of a discharge lamp according to the invention.

FIG. 1 shows a schematic illustration of a discharge lamp 1, which is in the form of a mercury discharge lamp. The discharge lamp 1 comprises a discharge vessel 2 with a discharge space 3, in which an anode 4 and a cathode 5 are arranged. The cathode 5 is connected to an electrode holder or a power supply line 5*a*. Correspondingly, the anode 4 is also connected to an electrode holder or power supply line 4*a*.

Bulb necks I, II are formed on both sides of the discharge vessel 2, with the electrode holder 4*a* of the anode 4 extending into the first bulb neck I, and the electrode holder 5*a* of the cathode 5 extending into the second bulb neck II.

The configuration of the bulb necks I, II will be explained in more detail below with reference to FIG. 2 to FIG. 12. In the exemplary embodiment, the two bulb necks I and II have a similar design, and reference is only made below to the bulb neck I.

Figure 2:
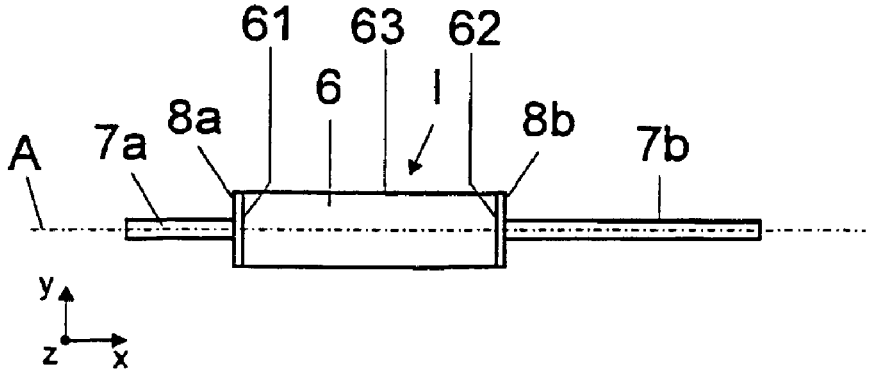
FIG. 2 to FIG. 12 show schematic sectional illustrations of a plurality of intermediate states in the production of a bulb neck for a discharge lamp as shown in FIG. 1.

FIG. 2 shows a schematic illustration of a manufacturing step for producing the bulb neck I, in which a cylindrical quartz bar 6 is provided, with a first plate 8*a* bearing against the first end side 61 and a first plate 8*b* bearing against the opposite end side 62 of said quartz bar 6. In the exemplary embodiment, the two first plates 8*a* and 8*b* have two-dimensional dimensions in the y-z plane, which dimensions correspond to the dimensions of the end sides 61 and 62, respectively. The first plates 8*a* and 8*b* are therefore arranged flush with the outer side or the lateral surface 63 of the quartz bar 6. A first power supply line 7*a* is connected to the first plate 8*a*, which is arranged on the left-hand side. On the opposite side, the first plate 8*b* is connected to a second power supply line 7*b*. The second power supply line 7*b* corresponds to the exemplary embodiment of the power supply line or electrode holder 4*a* in FIG. 1 and therefore extends into the discharge space 3.

The first bar-shaped power supply line 7*a* is soldered to the first plate 8*a* in the same way as the power supply line 7*b* arranged on the right is soldered to the first plate 8*b* arranged there.

Figure 3:
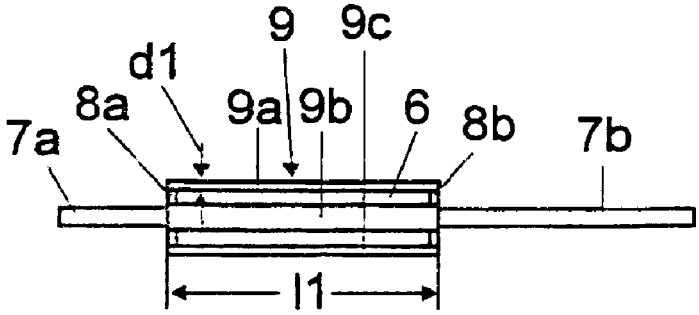

FIG. 3 shows a further manufacturing step in which a first film arrangement 9 comprising the film strips 9*a*, 9*b* and 9*c* shown is fitted on the lateral surface 63 of the quartz bar 6. The film strips 9*a* to 9*c* are arranged equidistantly with respect to one another and are positioned circumferentially around the lateral surface 63. As can be seen from the illustration in FIG. 3, the film strips 9*a* to 9*c* have a length (x direction) 11, which corresponds to the length of the quartz bar 6 and the thickness of the first plates 8*a* and 8*b*. The film strips 9*a* to 9*c* of the first film arrangement 9 are welded to the first plates 8*a* and 8*b*, in particular to the outer edges thereof. The films 9*a* to 9*c* of the first film arrangement 9 are in the form of molybdenum films. Preferably, these first film strips 9*a* to 9*c* have a thickness d1 of approximately 55 μm. The first plates 8*a* and 8*b* preferably have a diameter of approximately 17 mm in the exemplary embodiment.

Figure 4:
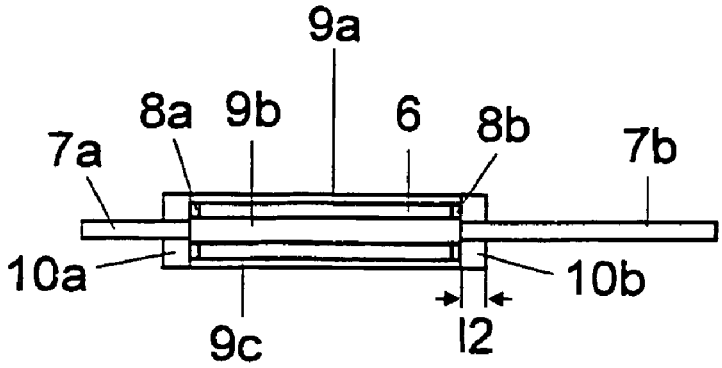

In a further manufacturing step for producing the bulb neck I, a respective first spacer element 10*a* and 10*b* is fitted on both sides of the quartz bar 6, when viewed in the longitudinal direction of the longitudinal axis A of the quartz bar 6, as shown in FIG. 4. These first spacer elements 10*a* and 10*b* are in the form of quartz tube sections. Preferably, these first spacer elements 10*a* and 10*b* have a length 12 (x direction) of between 5 mm and 15 mm, when viewed in the direction of the longitudinal axis A. In the exemplary embodiment, this length is approximately 10 mm.

As can be seen, the two first spacer elements 10*a* and 10*b* are preferably arranged so as to bear directly against the rear sides of the first plates 8*a* and 8*b*. Furthermore, they have two-dimensional dimensions in the y-z plane, which substantially correspond to the two-dimensional dimensions of the rear sides of the first plates 8*a* and 8*b* with the film strips 9*a* to 9*c* arranged thereon of the first film arrangement 9. In this case, too, substantially a flush transition between the first spacer elements 10*a* and 10*b* and the first plates 8*a* and 8*b* can thus be enabled.

Figure 5:
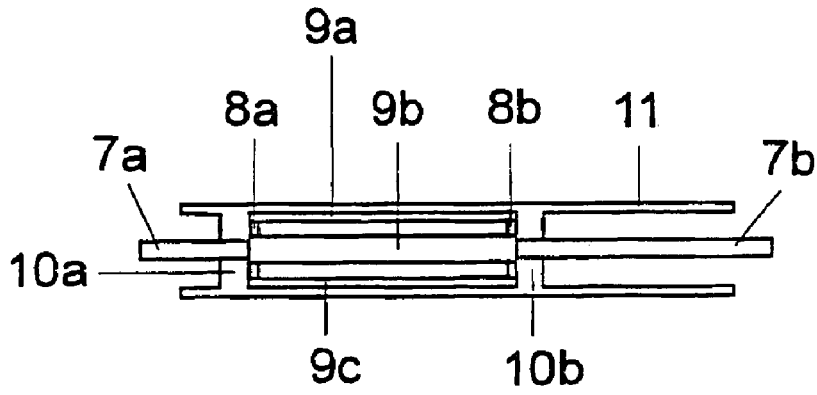
Figure 6:
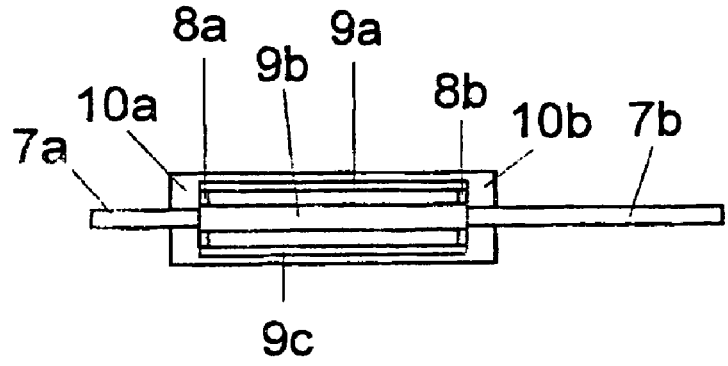

In a further manufacturing step as shown in the illustration in FIG. 5, a first outer tube 11 is then pushed over this intermediate arrangement produced in FIG. 4, and the outer tube 11 is fused or fuse-sealed with the intermediate arrangement shown in FIG. 4. If this first gas-tight fuse seal is produced, the system shown in FIG. 5 is rigid owing to the fixed connection and the mechanical stability is ensured by the soldered joints between the power supply lines 7*a*, 7*b* and the first plates 8*a* and 8*b*. As shown in the illustration in FIG. 6, in a subsequent step the first outer tube 11, which protrudes beyond the spacer elements 10*a* and 10*b* in FIG. 5, is severed by means of a suitable severing apparatus. Prior to or after the severing operation, the outer side of the first outer tube 11 can be planarized. As a result, the fitting of a further film arrangement can be positively influenced. Preferably, the outer tube 11 has a constant outer diameter over its entire length after the planarization.

Figure 7:
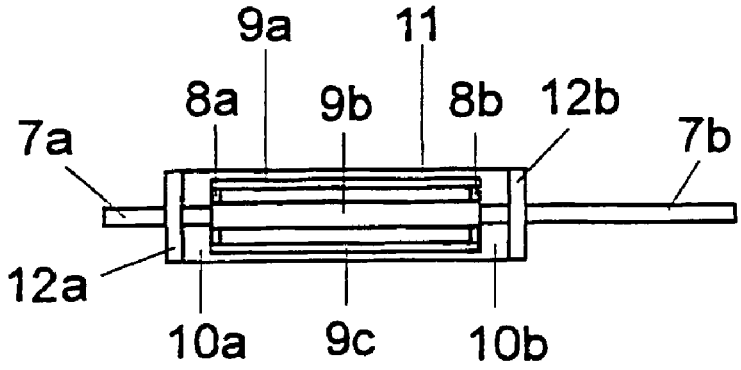

Subsequently, a respective second plate 12*a* and 12*b* is then fitted, when viewed in the direction of the longitudinal axis A, in accordance with the illustration in FIG. 7 in the exemplary embodiment. The two second plates 12*a* and 12*b* have two-dimensional dimensions in the y-z plane, which correspond to the outer dimensions of the first outer tube 11. In this case, too, a flush transition between the second plates 12*a* and 12*b* and the lateral surface of the outer tube 11 can thus be achieved. As can be seen, the two second plates 12*a* and 12*b* bear directly against the first spacer elements 10*a* and 10*b*.

Figure 8:
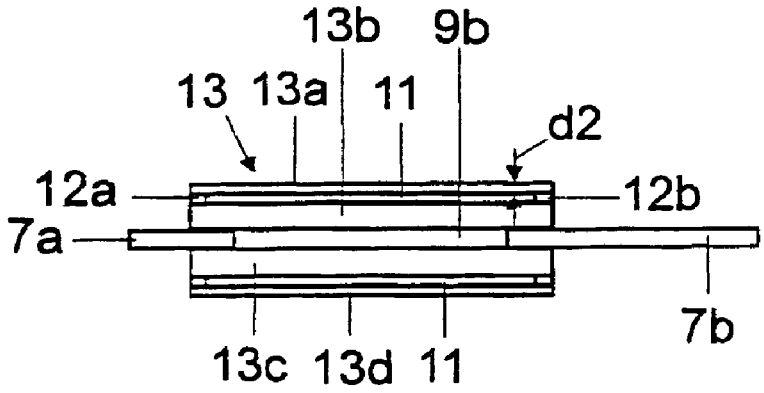

FIG. 8 shows a schematic illustration of a further manufacturing step in which a second film arrangement 13 is fitted. The second film arrangement 13 is formed from a plurality of film strips 13*a*, 13*b*, 13*c* and 13*d*. These film strips 13*a* to 13*d* are in turn fitted equidistantly, when viewed in the circumferential direction, on the outer side or lateral surface of the first outer tube 11.

The film strips 13*a* to 13*d* have a length (x direction), which corresponds to the length of the outer tube 11 and to the adjacent second plates 12*a* and 12*b*. The thickness d2 corresponds to approximately 55 μm.

The bulb neck I therefore comprises two film arrangements 9 and 13, which are formed with different radial distances from the longitudinal axis A of the quartz bar 6. In the exemplary embodiment, the glass material of the first outer tube 11 is arranged, as electrically insulating material, at least over the length of the quartz bar 6 and the first plates 8*a* and 8*b*, between the first film arrangement 9 and the second film arrangement 13.

The second plates 12*a* and 12*b*, which are arranged on both sides of the quartz bar 6 and therefore also on both sides of the first plates 8*a* and 8*b* and of the first spacer elements 10*a* and 10*b* in the exemplary embodiment, need to be connected to the power supply lines 7*a* and 7*b*, which are each arranged on the associated side. A soldered joint is not provided in this case since the glass/metal composite system generally does not withstand the high temperatures required for this purpose.

The exemplary embodiment provides that connecting elements in the form of elements 14*a* and 14*b* in the form of cylindrical hats are arranged between the second plates 12*a* and 12*b* and the power supply lines 7*a* and 7*b*, respectively. In this configuration, a second plate 12*a* or 12*b* is then not welded directly to the associated power supply line 7*a* or 7*b*, but this connecting element 14*a* or 14*b* in the form of a cylindrical hat is plugged onto the power supply line 7*a* with its tubular part 141, with the result that it bears against the rear side of the second plate 12*a* with the flat edge region 142. The dimensions of the edge region 142 are formed such that it substantially has the two-dimensional dimensions of the rear side of the second plates 12*a* and 12*b* and is therefore flush with said plates.

This element 14*a* is then welded to the power supply line 7*a* and the second plate 12*a*. A corresponding arrangement can be provided in the region of the second plate 12*b* and the power supply line 7*b*. The elements 14*a* and 14*b* in the form of cylindrical hats are formed from tantalum or another high-melting material in the exemplary embodiment.

Furthermore, provision may also be made for the second film arrangement 13 fitted in FIG. 8 to be connected, at least on one side of the quartz bar 6, directly to the first plate 8*a* or 8*b* fitted on this side or directly to the power supply line 7*a* or 7*b* fitted on this side. Given such a configuration, a second plate 12*a* or 12*b* is then not provided at least on one side of the quartz bar 6.

Figure 9:
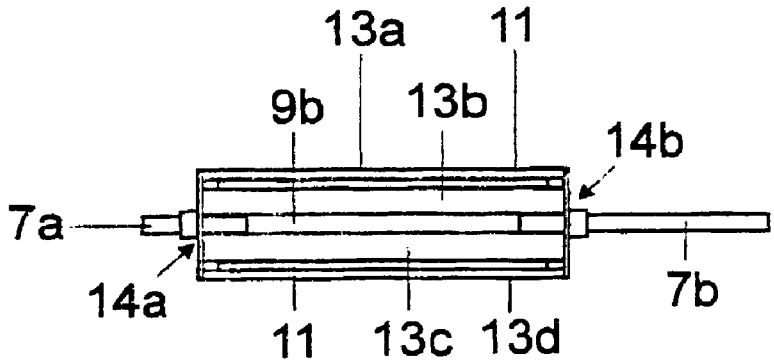
Figure 10:
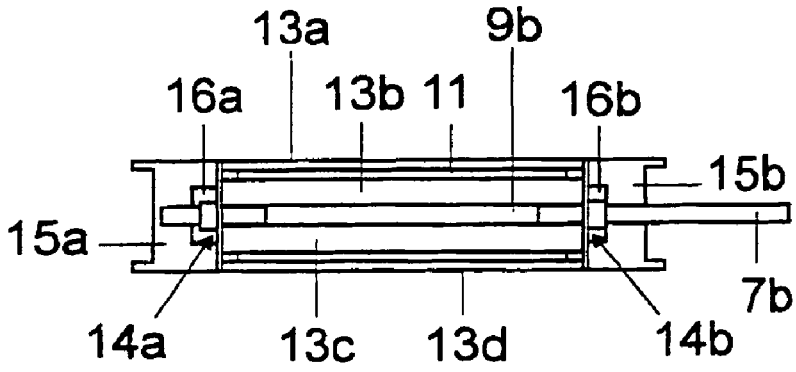

In a further manufacturing step in accordance with the illustration in FIG. 10, a respective second spacer element 15*a* and 15*b* is then arranged on both sides of the quartz bar 6, starting from the illustration in FIG. 9, which second spacer elements are in turn in the form of quartz tube sections. As can be seen from the illustration in FIG. 11, these second spacer elements 15*a* and 15*b* are formed and arranged in such a way that the elements 14*a* and 14*b* are arranged, in regions, in air gaps 16*a* and 16*b*. Furthermore, the second spacer elements 15*a* and 15*b* are formed with dimensions in the y-z plane which, in the exemplary embodiment, substantially correspond to the dimensions of the rear side of the second plates 12*a* and 12*b*. In this case, too, a flush transition between the second spacer elements 15*a* and 15*b* and the second plates 12*a* and 12*b* or the film strips 13*a* to 13*d* arranged thereon can thus again be achieved.

Figure 11:
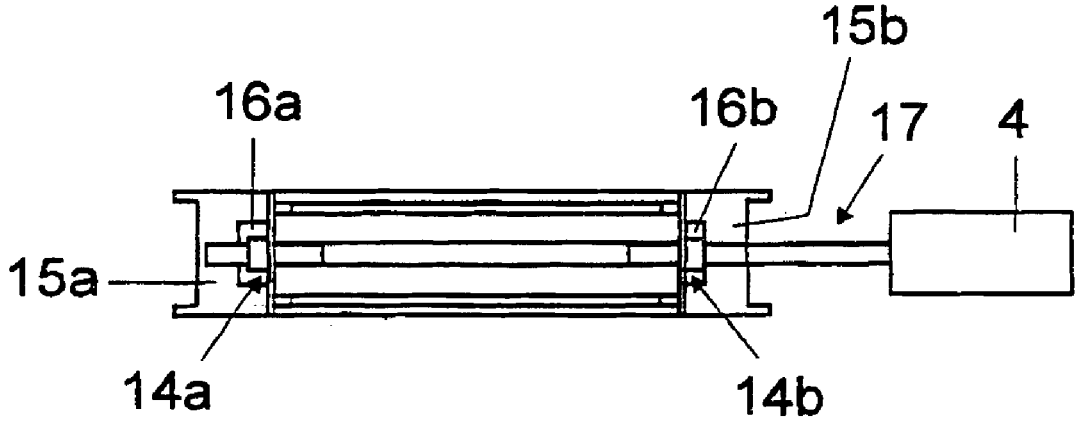

Furthermore, as shown in the illustration in FIG. 11, the anode 4 is fitted on the power supply line 7*b* facing the discharge space 3 on the front end thereof. This takes place by virtue of the fact that the anode is compressed or soldered with the power supply line 7*b*.

Before the anode 4 is fitted, a tapered supporting element is also fitted onto the second spacer element 15*b*, which supporting element is not illustrated in the illustration in FIG. 11 and whose position is merely indicated by the reference symbol 17.

Figure 12:
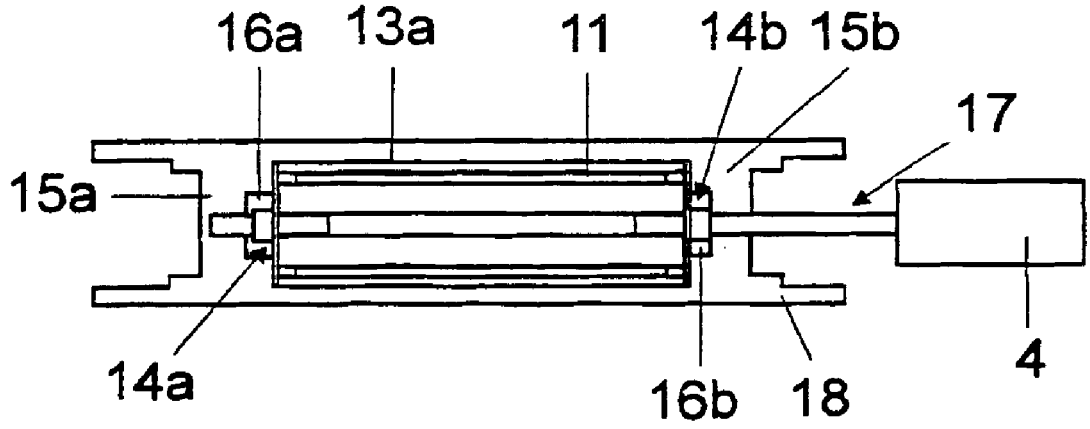
Figure 13:
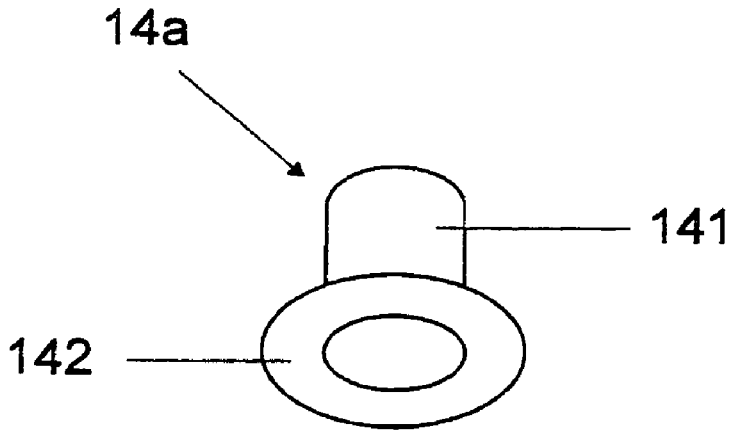
FIG. 13 shows a perspective illustration of a connecting element between a plate and a power supply line of the discharge lamp.

In a further manufacturing step for producing the bulb neck I, a second outer tube 18 is then pushed onto the arrangement manufactured in FIG. 11, in accordance with the illustration in FIG. 12, and fused or fused-in with the system manufactured in advance in accordance with the illustration in FIG. 11. The system shown in FIG. 11 can then be fused into the discharge lamp 1 as a complete electrode system in accordance with the illustration in FIG. 12. The second outer tube 18 is in this case integrally connected to the discharge vessel 2, and the system shown in FIG. 12 is fuse-sealed in a gas-tight manner.

Figure 14:
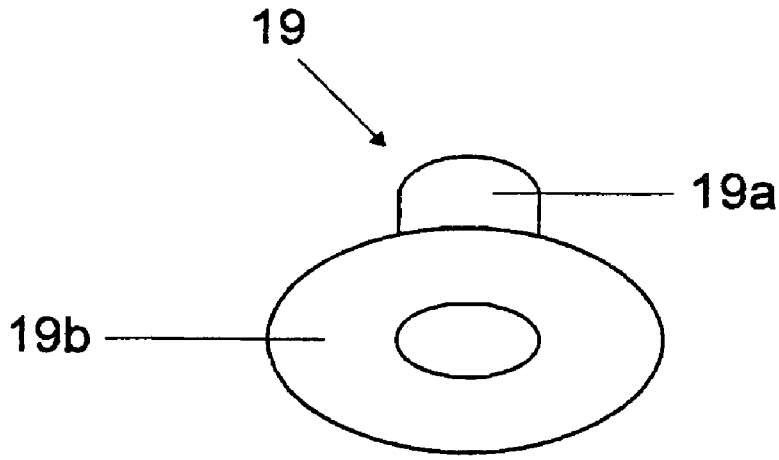
FIG. 14 shows a perspective illustration of a connecting part, which can be connected to the second film arrangement, on the one hand, and to a power supply line, on the other hand.

If the two second plates 12*a* and 12*b* are not provided, the film strips 13*a* to 13*d* can be welded directly to the power supply lines 7*a* and 7*b*. Furthermore, provision may also be made for a connecting part 19 in the form of a cylindrical hat to be provided, as is shown in the perspective illustration in FIG. 14. This connecting part 19 can be welded with its tubular section 19*a* to the associated power supply line 7*a* or 7*b*. The film strips 13*a* to 13*d* can be welded at their end regions to the flat ring 19*b* of the connecting part 19. For this purpose, the film strips 13*a* to 13*d* can each be flanged at their end regions and welded to this flat ring 19*b*.

A system or a bulb neck I as is shown in terms of manufacturing steps in FIGS. 2 to 12 and in terms of its final arrangement in FIG. 12, makes it possible to ensure a significantly higher dielectric strength given the same electrode system diameters in comparison with the prior art. If, for example, first plates with a diameter of 17 mm and second plates with a diameter of approximately 22 mm and first and second film arrangements 9 and 13 with thicknesses d1 and d2 of approximately 55 μm are used, a current loading of more than 300 A is possible. Previous systems with plate diameters of approximately 22 mm can be loaded with a maximum current of approximately 220 A. In addition, the invention makes it possible to achieve the fact that the electrode system diameter can be kept relatively small at very high current loadings, as a result of which a significant advantage can be achieved, in particular as regards the bursting pressure resistance, since this bursting pressure resistance scales with the diameter. In particular in the case of discharge lamps which are used for backlighting display areas, in particular in the LCD sector, a considerable advantage can thus be achieved. Furthermore, with the given diameter and the given current level, the film thickness can be reduced in comparison with the prior art, which also has an advantageous effect on the bursting pressure resistance.

The invention claimed is:

1. A discharge lamp with a discharge vessel (2) and at least one bulb neck (I, II) adjacent thereto with a quartz bar (6) arranged inside the at least one bulb neck (I,II) and a first film arrangement (9) arranged on the outer side (63) of the quartz bar (6), which film arrangement is connected to power supply lines (7*a*, 7*b*) for an electrode (4, 5) which are arranged on both sides of the quartz bar (6), characterized in that the bulb neck (I, II) comprises at least one second film arrangement (13) arranged inside the at least one bulb neck (I,II), which is connected to the power supply lines (7*a*, 7*b*) and is at a greater distance from the longitudinal axis (A) of the quartz bar (6) than the first film arrangement (9) characterized in that an electrically insulating material is formed as a first outer tube (11), in particular a glass material, between the first film arrangement (9) and the second film arrangement (13) in the direction of the longitudinal axis (A).

2. The discharge lamp as claimed in claim 1, characterized in that the first film arrangement (9) is arranged directly on the outer side (63) forming the lateral surface of the quartz bar (6).

3. The discharge lamp as claimed in claim 1 or 2, characterized in that the first film arrangement (9) and the second film arrangement (13) each comprise a plurality of film strips (9*a* to 9*c*; 13*a* to 13*d*).

4. The discharge lamp as claimed in claim 3, characterized in that the film strips (9*a* to 9*c*) of the first film arrangement (9) are arranged, in the circumferential direction of the quartz bar (6), equidistantly with respect to one another on the outer side (63) and at a first distance from the longitudinal axis (A) of the quartz bar (6), and the film strips (13*a* to 13*d*) of the second film arrangement (13) are arranged equidistantly with respect to one another on the outer side (63) and at a second distance from the longitudinal axis (A) of the quartz bar (6).

5. The discharge lamp as claimed in claim 1, characterized in that a second outer tube (18) of the bulb neck (I, II) is arranged on the outer side of the second film arrangement (13).

6. The discharge lamp as claimed in claim 1, characterized in that at least one of the power supply lines (7*a*, 7*b*) is connected to a first plate (8*a*, 8*b*), which first plate (8*a*, 8*b*) bears against an end side (61, 62) of the quartz bar (6) and is connected to the first film arrangement (9).

7. The discharge lamp as claimed in claim 6, characterized in that at least one of the power supply lines (7*a*, 7*b*) is connected to a second plate (12*a*, 12*b*), which second plate (12*a*, 12*b*) is connected to the second film arrangement (13) and is arranged so as to be spaced apart from the first plate (8*a*, 8*b*) in the direction of the longitudinal axis (A).

8. The discharge lamp as claimed in claim 7, characterized in that a first spacer element (10*a*, 10*b*) is arranged between the first plate (8*a*, 8*b*) and the second plate (12*a*, 12*b*) on one side of the quartz bar (6).

9. The discharge lamp as claimed in claim 7, characterized in that the first plate (8*a*, 8*b*) has a smaller diameter than the second plate (12*a*, 12*b*).

10. The discharge lamp as claimed in claim 7, characterized in that the second plate (12*a*, 12*b*) and the power supply line (7*a*, 7*b*) are connected by a connecting element (14*a*, 14*b*).

11. The discharge lamp as claimed in claim 10, characterized in that the connecting element is an element (14*a*, 14*b*) in the form of a cylindrical hat, which has been pushed onto the bar-shaped power supply line (7*a*, 7*b*), bears against the rear side of the second plate (12*a*, 12*b*) and is welded to the second plate (12*a*, 12*b*) and the power supply line (7*a*, 7*b*).

12. The discharge lamp as claimed in claim 10, characterized in that the connecting element (14*a*, 14*b*) is formed from a high-melting material.

13. The discharge lamp as claimed in claim 1, characterized in that the second film arrangement (13) is connected at least on one side of the quartz bar (6), directly to the power supply line (7*a*, 7*b*) arranged on this side.

14. The discharge lamp as claimed in claim 1, characterized in that the second film arrangement (13) is connected, at least on one side of the quartz bar (6), directly to a connecting part (19) in the form of a cylindrical hat, which is connected directly to the power supply line (7*a*, 7*b*).

15. The discharge lamp as claimed in claim 10, characterized in that a second spacer element (15*a*, 15*b*) is arranged in the longitudinal axis direction (A) on that side of the connecting element (14*a*, 14*b*) or of the connecting part (19) which is remote from the quartz bar (6).

16. The discharge lamp as claimed in claim 10, characterized in that a supporting element (17) is arranged in the longitudinal axis direction (A) on that side of the connecting element (14*a*, 14*b*) or of the connecting part (19) which is remote from the quartz bar (6).

17. The discharge lamp as claimed in claim 16, characterized in that the supporting element (17) is a tapered supporting element made from a glass material and, with its tapered end region, faces the discharge space (3) of the discharge vessel (2).

18. A method for producing a bulb neck (I, II) for a discharge lamp (1), which bulb neck (I, II) is formed on a discharge vessel (2), in which method a quartz bar (6) is formed on the inside in the bulb neck (I, II), and a first film arrangement (9) is formed on the outer side (63) of the quartz bar (6), which first film arrangement is connected to power supply lines (7*a*, 7*b*) for an electrode (4, 5) which are arranged on both sides of the quartz bar (6), characterized in that a second film arrangement (13) is formed in the bulb neck (I, II), which second film arrangement is connected to the power supply lines (7*a*, 7*b*) and is formed at a greater distance from the longitudinal axis (A) of the quartz bar (6) than the first film arrangement (9);

a glass material is formed between the first film arrangement (9) and the second film arrangement (13); and the second film arrangement (13) is applied to the outer side of the first outer tube (11) and is connected to the power supply lines (7*a*, 7*b*).

19. The method as claimed in claim 18, characterized in that a plurality of equidistantly arranged film strips (9*a* to 9*c*) are formed parallel to one another on the outer side (63), which forms the lateral surface, of the quartz bar (6), which film strips are connected to a first plate (8*a*, 8*b*) at least on one side, the first plate (8*a*, 8*b*) being connected to the power supply line (7*a*, 7*b*) arranged on this side.

20. The method as claimed in claim 18 or 19, characterized in that first spacer elements (10*a*, 10*b*) are fitted on both sides of the quartz bar (6), and a first outer tube (11) is pushed onto the quartz bar (6), the first film arrangement (9), the at least one first plate (8*a*, 8*b*) and the first spacer elements (10*a*, 10*b*), and this intermediate system thus formed is fuse-sealed.

21. The method as claimed in one of claim 18 or 19, characterized in that the first film arrangement (9) is formed at a smaller distance from the longitudinal axis (A) of the quartz bar (6) than the second film arrangement (13).

22. The method as claimed in claim 18, characterized in that the second film arrangement (13) is connected at least on one side of the quartz bar (6), directly to the power supply line (7*a*, 7*b*) arranged on this side.

23. The method as claimed in claim 22, characterized in that a second plate (12*a*, 12*b*), which is connected to the second film arrangement (13), is arranged at least on one side of the quartz bar (6).

24. The method as claimed in claim 23, characterized in that the second plate (12*a*, 12*b*) is connected, to a power supply line (7*a*, 7*b*) by a connecting element, in particular by a connecting element (14*a*, 14*b*) in the form of a cylindrical hat.

25. The method as claimed in claim 23, characterized in that at least on one side of the quartz bar (6), when viewed in the direction of the longitudinal axis (A), a second spacer element (15*a*, 15*b*) is arranged on that side of the first spacer element (10*a*, 10*b*) which is remote from the quartz bar (6) on that side of the second plate (12*a*, 12*b*) or of the connecting element (14*a*, 14*b*) which is remote from the quartz bar (6).

26. The method as claimed in claim 25, characterized in that once an electrode (4, 5) has been fitted on the power supply line (7*b*) facing the discharge space (3), this final system is introduced into a second outer tube (18) and fused therewith in a gas-tight manner.

27. The discharge lamp as claimed in claim 1, characterized in that both of the power supply lines (7*a*, 7*b*) are connected to a respective first plate (8*a*, 8*b*), which first plate (8*a*, 8*b*) bears against an end side (61, 62) of the quartz bar (6) and is connected to the first film arrangement (9).

28. The discharge lamp as claimed in claim 27, characterized in that both of the power supply lines (7*a*, 7*b*) are connected to a respective second plate (12*a*, 12*b*), which second plate (12*a*, 12*b*) is connected to the second film arrangement (13) and is arranged so as to be spaced apart from the first plate (8*a*, 8*b*) in the direction of the longitudinal axis (A).

29. The discharge lamp as claimed in claim 10, characterized in that the connecting element (14*a*, 14*b*) is formed from a high-melting material which is at least partially tantulum.

* * * * *